US008978705B2

(12) United States Patent
Marica

(10) Patent No.: US 8,978,705 B2
(45) **Date of Patent: *Mar. 17, 2015**

(54) APPARATUS FOR REDUCING TURBULENCE IN A FLUID STREAM

(75) Inventor: Adrian Marica, Cypress, TX (US)

(73) Assignee: National Oilwell Varco, L.P., Houston, TX (US)

( * ) Notice: Subject to any disclaimer, the term of this patent is extended or adjusted under 35 U.S.C. 154(b) by 358 days.

This patent is subject to a terminal disclaimer.

(21) Appl. No.: 13/529,804

(22) Filed: Jun. 21, 2012

(65) Prior Publication Data

US 2013/0340873 A1 Dec. 26, 2013

Related U.S. Application Data

(63) Continuation of application No. 12/478,015, filed on Jun. 4, 2009, now Pat. No. 8,220,496.

(51) Int. Cl.
*F15D 1/04* (2006.01)

(52) U.S. Cl.
USPC ..... 138/37; 138/39; 251/118

(58) Field of Classification Search
USPC ..... 138/37, 39, 46; 137/39; 251/118; 285/223
See application file for complete search history.

(56) References Cited

U.S. PATENT DOCUMENTS

| | | | | |
|---|---|---|---|---|
| 1,115,699 A | | 11/1914 | Loose | |
| 1,182,954 A | | 5/1916 | Wolf | |
| 1,583,196 A | | 5/1926 | Stewart | |
| 1,657,891 A | | 1/1928 | Miller | |
| 1,683,089 A | | 9/1928 | Mills | |
| 1,689,446 A | | 10/1928 | Miller et al. | |
| 1,778,790 A | | 10/1930 | Hans et al. | |
| 1,868,902 A | | 7/1932 | Jackson | |
| 2,700,595 A | | 1/1955 | Probst | |
| 4,077,570 A | * | 3/1978 | Harmony | 239/107 |
| 4,080,997 A | | 3/1978 | Biornstad | |
| 4,487,510 A | * | 12/1984 | Buurman et al. | 366/337 |
| 4,706,999 A | * | 11/1987 | Hynes | 285/196 |
| 4,821,768 A | | 4/1989 | Lett | |
| 4,905,940 A | * | 3/1990 | Luka | 248/56 |
| 4,934,745 A | * | 6/1990 | Healy | 285/255 |
| 5,145,216 A | * | 9/1992 | Valls, Jr. | 285/140.1 |
| 5,520,507 A | | 5/1996 | Haugen | |
| 5,855,709 A | | 1/1999 | Bocoviz et al. | |

(Continued)

FOREIGN PATENT DOCUMENTS

| | | |
|---|---|---|
| JP | 2803498 B2 | 9/1998 |
| JP | 2007-180700 | 12/2007 |

OTHER PUBLICATIONS

International Application No. PCT/US2010/035505 Search Report and Written Opinion dated Dec. 30, 2010 (9 pages).

(Continued)

*Primary Examiner* — Patrick F Brinson
(74) *Attorney, Agent, or Firm* — Conley Rose, P.C.

(57) ABSTRACT

A system for conveying fluid includes a conduit segment and a pump disposed downstream of and fluidicly coupled to the conduit segment. The conduit segment has an interior volume for conveying the fluid in a predetermined direction of flow and a plurality of elongate vanes disposed within the interior volume.

23 Claims, 8 Drawing Sheets

(56) References Cited

U.S. PATENT DOCUMENTS

| | | | | |
|---|---|---|---|---|
| 5,961,155 | A * | 10/1999 | Youngs | 285/139.1 |
| 5,975,141 | A | 11/1999 | Higazy | |
| 5,992,465 | A | 11/1999 | Jansen | |
| 6,536,467 | B2 | 3/2003 | Wu et al. | |
| 6,684,907 | B2 * | 2/2004 | Yang et al. | 138/37 |
| 6,805,299 | B1 | 10/2004 | Wasmer et al. | |
| 7,090,153 | B2 | 8/2006 | King et al. | |
| 7,780,408 | B2 | 8/2010 | Lazzarato et al. | |
| 2008/0190214 | A1 | 8/2008 | Ubowski et al. | |
| 2009/0098818 | A1 | 4/2009 | Gruenberg | |

OTHER PUBLICATIONS

"Patent Abstracts of Japan" for Japanese Publication No. 2007-180700, Publication Date of Abstract: Unknown, Publication Date of Application: Dec. 7, 2007 (1 page).

"Abstract of JP 6146335 (A)", Japanese Publication No. JP2803498 (B2), Publication Date of Abstract: Unknown, Publication Date of Application: Sep. 24, 1998 (1 page).

Canadian Patent Application No. 2762827 Office Action dated Feb. 5, 2014 (3 pages).

* cited by examiner

APPARATUS FOR REDUCING TURBULENCE IN A FLUID STREAM

CROSS-REFERENCE TO RELATED APPLICATIONS

The present application is a continuation of U.S. patent application Ser. No. 12/478,015, filed on Jun. 4, 2009, entitled "Apparatus For Reducing Turbulence In A Fluid Stream", the disclosure of which is incorporated herein by reference.

STATEMENT REGARDING FEDERALLY SPONSORED RESEARCH OR DEVELOPMENT

Not applicable.

BACKGROUND

The disclosure relates generally to apparatus for reducing turbulence in a fluid stream and damping pressure pulsations propagated by the fluid. More particularly, the disclosure relates to a flow straightening device that reduces turbulence in moving fluid. Still more particularly, it relates to a flow straightener that reduces turbulence of drilling fluid passing through a mud pump and that dampens pressure pulsations propagated by the drilling fluid.

To form an oil or gas well, a bottom hole assembly (BHA), including a drill bit, is coupled to a length of drill pipe to form a drill string. Instrumentation for performing various downhole measurements and communication devices are commonly mounted within the drill string. The drill string is then inserted downhole, where drilling commences. During drilling, fluid, or "drilling mud," is circulated down through the drill string to lubricate and cool the drill bit as well as to provide a vehicle for removal of drill cuttings from the borehole.

Mud pumps are commonly used to deliver drilling mud to the drill string during drilling operations. Many conventional mud pumps include a piston-cylinder assembly hydraulically coupled to a compression chamber disposed between a suction module and a discharge module. The suction module is coupled to a suction manifold through which drilling mud is supplied to the mud pump, and the discharge module is coupled to a discharge manifold into which pressurized drilling mud is exhausted from the mud pump. The suction module includes a valve which is operable to allow or prevent the flow of drilling mud from the suction manifold into the compression chamber. Similarly, the discharge module includes a valve which is operable to allow or prevent the flow of pressurized drilling mud from the compression chamber into the discharge manifold. Each valve has a closure member or poppet that is urged into sealing engagement with a sealing member or seat by a biasing member, such as a spring.

During operation of the mud pump, the piston reciprocates within its associated cylinder. As the piston moves to expand the volume within the cylinder, the discharge valve closes, and suction valve opens. Drilling mud is drawn from the suction manifold through the suction valve into the compression chamber. When the piston reverses direction, decreasing the volume within the cylinder and increasing the pressure of drilling mud contained with the compression chamber, the suction valve closes, and the discharge valve opens to allow pressurized drilling mud from the compression chamber into the discharge manifold. While the mud pump is operational, this cycle repeats, often at a high cyclic rate, and pressurized drilling mud is continuously fed to the drill string.

Due to the reciprocating motion of the mud pump piston, cyclic loads are transferred to the suction module by virtue of its coupling to the mud pump. The transferred loads cause cyclic deformation of the suction module. Consequently, pressure pulsations are created within and propagated by the drilling mud passing therethrough.

Additionally, because the suction module typically includes piping elbows, bends, and "Ts," drilling mud flowing from the suction manifold into the suction module, upstream of the suction valve, is often highly turbulent. When the suction valve opens, the turbulent drilling mud flows rapidly into the compression chamber. Due to the turbulent nature of the drilling fluid, bubbles form within the compression chamber as the drilling fluid flows rapidly around the suction valve poppet. When the piston subsequently compresses the drilling mud within the compression chamber, these bubbles burst, creating additional pressure pulsations within the drilling mud.

The formation of bubbles within the compression chamber due to the turbulent nature of drilling mud passing around the suction valve poppet reduces the efficiency of the mud pump. Moreover, pressure pulsations created within and carried by the drilling mud disturb downhole communication devices and instrumentation, and potentially degrade the accuracy of measurements taken by the instrumentation. Over time, the pressure pulsations may also cause fatigue damage to the drill string pipe.

Accordingly, there is a need for apparatus that reduces turbulence within drilling mud systems and that dampens pressure pulsations caused by the reciprocating motion of mud pumps coupled thereto.

SUMMARY OF THE DISCLOSURE

A flow straightener includes a conduit segment and a plurality of elongate vanes. The conduit segment has an inner surface and an interior volume for conveying the fluid in a predetermined direction of flow. The elongate vanes are disposed within the interior volume. Each of the vanes has a radially innermost edge and a radially outermost edge. The innermost edges of the vanes are spaced apart from one another so as to provide a core portion of the interior volume that is generally free of obstruction.

In some embodiments, the flow straightener includes the conduit section and a plurality of pins that support the vanes within the interior volume. The pins are flexibly coupled to the inner surface of the conduit segment. Likewise, in certain embodiments, the flexible coupling includes an elastomeric insert having tapered sides that engage correspondingly tapered sides of a recess formed in the conduit section. The cross-sectional shape of the pins may be noncircular in various embodiments.

Thus, embodiments described herein comprise a combination of features and characteristics intended to address various shortcomings associated with certain prior devices. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a detailed description of the disclosed embodiments, reference will now be made to the accompanying drawings in which.

DETAILED DESCRIPTION OF THE DISCLOSED EMBODIMENTS

Figure 1:
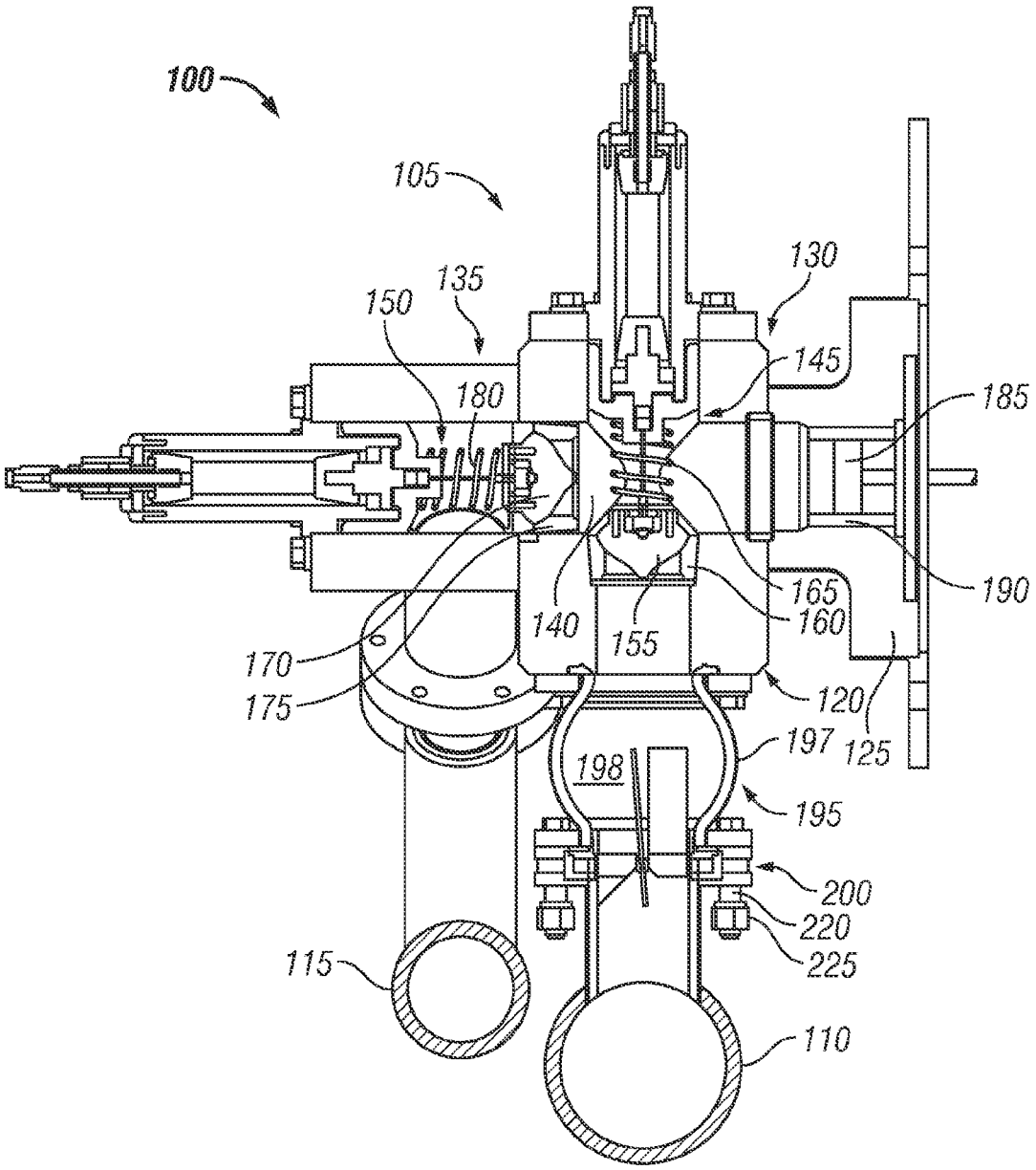
FIG. 1 is a cross-sectional view of a drilling fluid system including a fluid flow straightener in accordance with the principles disclosed herein.

The following description is directed to an exemplary embodiment of a drilling fluid system including a fluid flow straightener. The embodiment disclosed should not be interpreted, or otherwise used, as limiting the scope of the disclosure, including the claims. One skilled in the art will understand that the following description has broad application, and that the discussion is meant only to be exemplary of the described embodiment, and not intended to suggest that the scope of the disclosure, including the claims, is limited to that embodiment. For example, the apparatus described herein may be employed in any fluid conveyance system where it is desirable to reduce the turbulence of fluid contained within or moving through the system.

Certain terms are used throughout the following description and the claims to refer to particular features or components. As one skilled in the art will appreciate, different persons may refer to the same feature or component by different names. This document does not intend to distinguish between components or features that differ in name but not function. Moreover, the drawing figures are not necessarily to scale. Certain features and components described herein may be shown exaggerated in scale or in somewhat schematic form, and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection, or through an indirect connection via other devices and connections. Further, the terms "axial" and "axially" generally mean along or parallel to a central or longitudinal axis. The terms "radial" and "radially" generally mean perpendicular to the central or longitudinal axis, while the terms "azimuth" and "azimuthally" generally mean perpendicular to both the central or longitudinal axis and a radial axis normal to the central longitudinal axis. As used herein, these terms are consistent with their commonly understood meanings with regard to a cylindrical coordinate system.

Referring now to FIG. 1, there is shown a drilling fluid system 100 configured to pressurize drilling fluid, or drilling mud. Drilling fluid system 100 includes a pump assembly 105 coupled between a suction manifold 110 and a discharge manifold 115. Suction manifold 110 is coupled to a fluid source (not shown), for example, a storage tank commonly found at many drilling sites. Discharge manifold 115 is coupled to a fluid destination (not shown), such as but not limited to a drill string. A flow straightener 200 in accordance with the principles disclosed herein and a flexible connection 195 are coupled between suction manifold 110 and pump assembly 105.

Pump assembly 105 includes a pump 125 and a valve assembly 120. Pump 125 is a reciprocating pump, having a piston 185 slidingly disposed within a cylinder 190. Valve assembly 120 includes a suction module 130, a discharge module 135, and a fluid conduit or compression chamber 140 disposed therebetween. Pump 125, suction manifold 110, and discharge manifold 115 are each hydraulically or fluidicly coupled to compression chamber 140. Suction module 130 includes a valve 145 that is operable to allow or prevent the flow of fluid from suction manifold 110 into compression chamber 140. Suction valve 145 has a closure member or poppet 155 that is urged into sealing engagement with a sealing member or seat 160 by a biasing member 165, such as a spring. Similarly, discharge module 135 includes a valve 150 that is operable to allow or prevent the flow of pressurized fluid from compression chamber 140 into discharge manifold 115. Discharge valve 150 also has a closure member or poppet 170 that is urged into sealing engagement with a sealing member or seat 175 by a biasing member 180, such as a spring.

Flexible connection 195 is configured to reduce the transfer of cyclic loads produced by the reciprocating motion of pump 125 from pump assembly 105 to suction manifold 110. Such loads cause cyclic deformation of suction manifold 110, which, in turn, produces pressure pulsations within fluid passing through suction manifold 110. As previously described, pressure pulsations may disturb downstream instrumentation and communication devices, and/or cause fatigue damage to downstream piping.

In the embodiment shown in FIG. 1, flexible connection 195 includes a spherically-shaped, elastomeric chamber or body 197 with a flowbore 198 extending therethrough. Flowbore 198 is hydraulically coupled between compression chamber 140 within pump assembly 105 and suction manifold 110. As such, compression chamber 140, flowbore 198, and suction manifold 110 may be said to be in fluid communication with one another. Thus, flowbore 198 enables the flow of fluid from suction manifold 110 to pump assembly 105. During operation of pump 125, elastomeric body 197 flexes, twists, and otherwise deforms in response to movement of pump assembly 105. However, due to the flexible nature of body 197, structural loads to suction manifold 110 due to movement of pump assembly 105 are reduced, in comparison to that which would otherwise be experienced in the absence of a flexible coupling between pump assembly 105 and suction manifold 110. As a result, cyclic deformation of suction manifold 110 due to the reciprocating motion of pump 125 and pressure pulsations resulting therefrom are also reduced.

Figure 2:
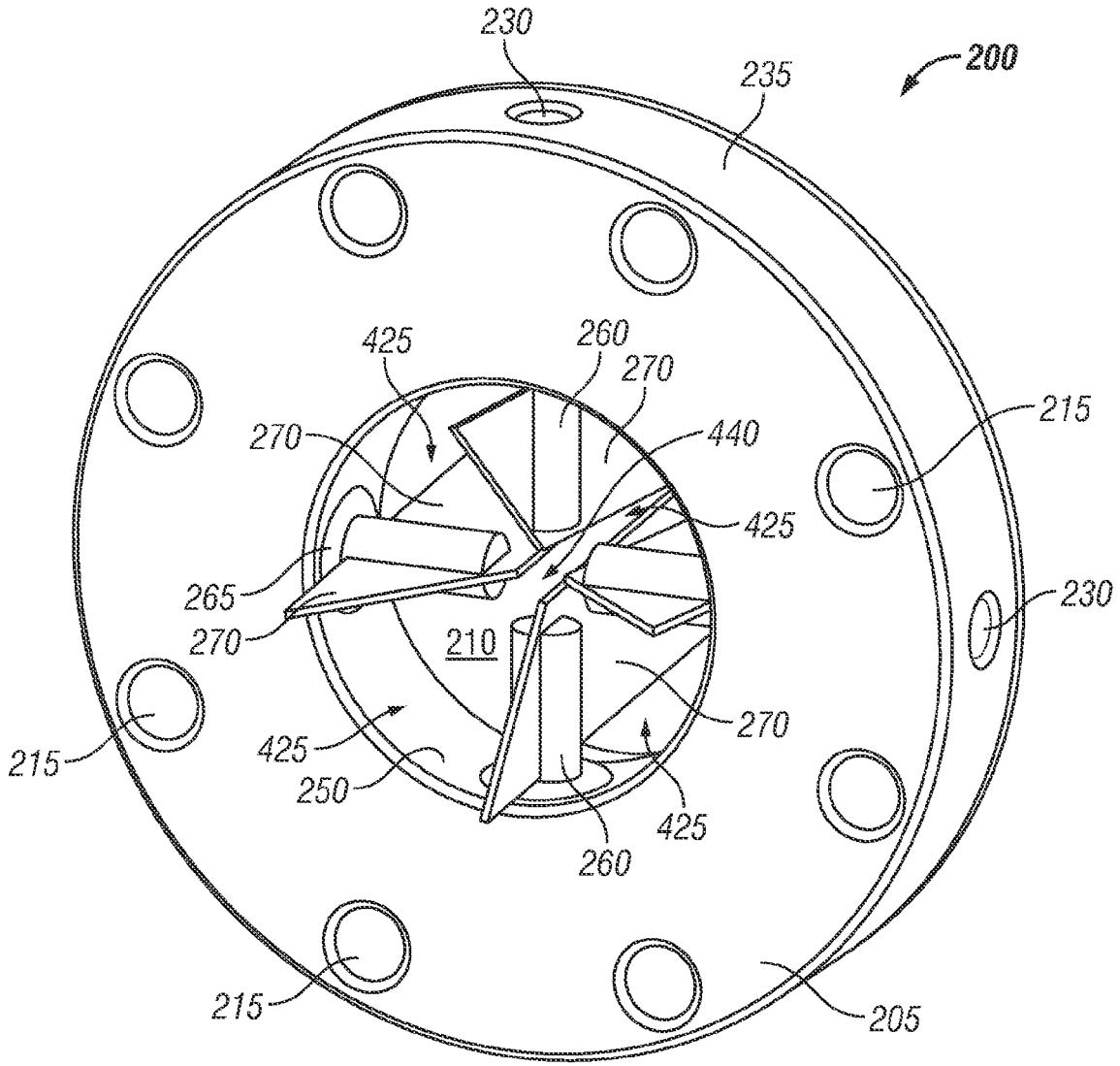
FIG. 2 is a perspective view of the flow straightener of FIG. 1.

Turning now to FIG. 2, flow straightener 200 includes a conduit segment 205 having a flowbore 210 extending therethrough and generally defined by the conduit segment's generally cylindrical inner surface 250. Flowbore 210 enables fluid communication between suction manifold 110 (FIG. 1) and flowbore 198 (FIG. 1) of flexible connector 195. Flow straightener 200 further includes a plurality of pins 260 extending substantially radially from segment 205 into flowbore 210. In the embodiment shown, each pin 260 is coupled to segment 205 by a flexible insert 265, and supports a vane 270. Vanes 270 essentially subdivide flowbore 210 into an equal number of flow channels 425 through which fluid passes. Flow straightener 200 preferably includes more than two vanes 270 positioned circumferentially within flowbore 210 an equal distance apart. In this embodiment, flow straightener 200 has four equally spaced vanes 270.

Conduit segment 205 further includes a plurality of axially extending throughbores 215 circumferentially spaced about segment 205 near its perhiphery. Throughbores 215 enable coupling of flow straightener 200 between flexible connection 195 and suction manifold 110. To couple flow straightener 200 between flexible connection 195 and suction manifold 110, as shown in FIG. 1, a bolt 220 is inserted through each throughbore 215 and adjacent, aligned bores in flexible connector 195 and suction manifold 110, and secured in position with a threaded nut 225. Referring again to FIG. 2, in this embodiment, flow straightener 200 includes eight throughbores 215 equally spaced about the periphery of segment 205. However, in other embodiments, flow straightener 200 may include fewer or more throughbores 215. Moreover, in such embodiments, throughbores 215 may be nonuniformly spaced about segment 205.

Figure 3:
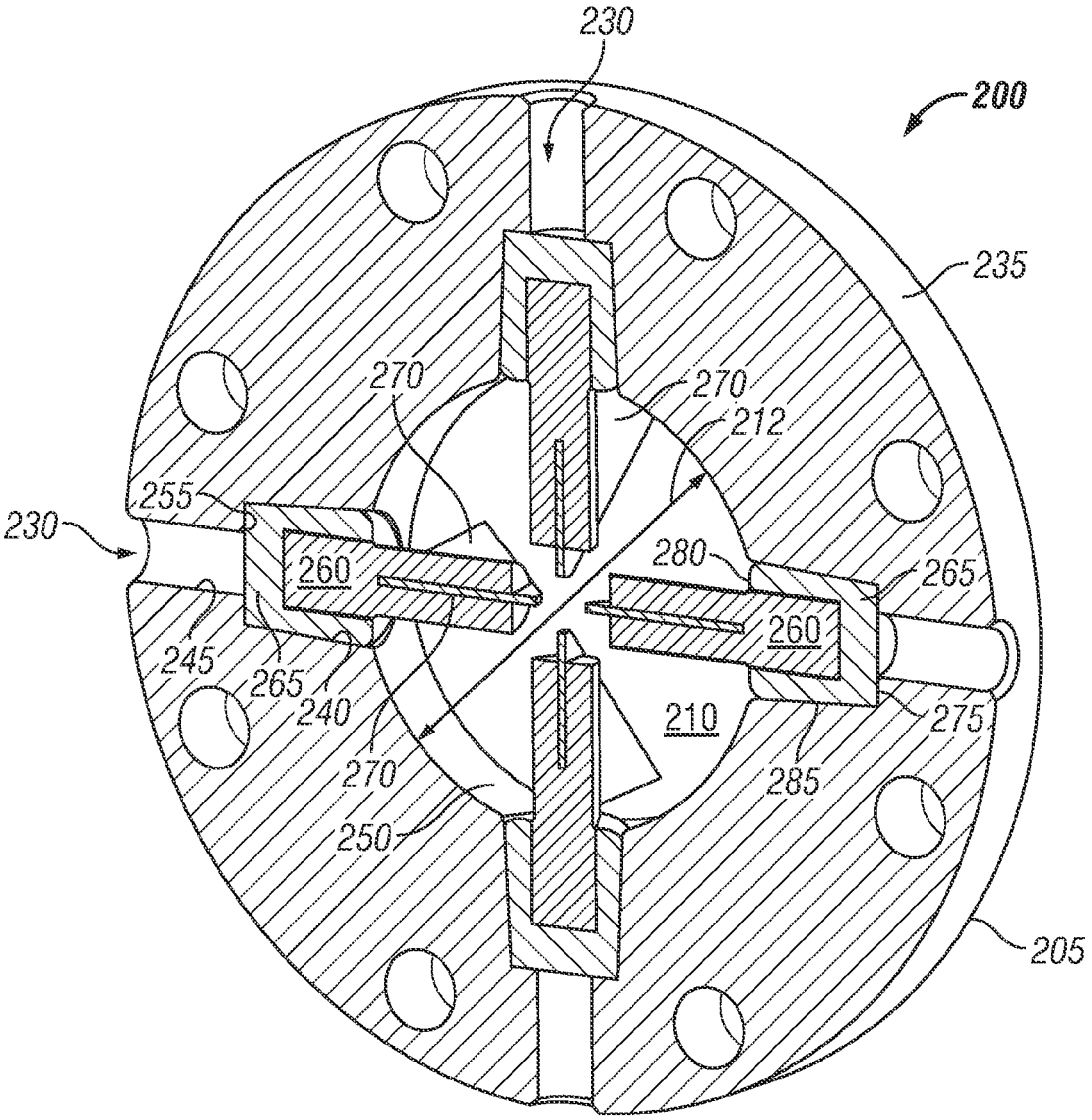
FIG. 3 is a cross-sectional view of the flow straightener of FIG. 2.

Conduit segment 205 further includes a plurality of throughbores 230, each throughbore 230 extending radially between a generally cylindrical outer surface 235 of segment 205 and flowbore 210. As shown in FIG. 3, which is a radial cross-section of segment 205 taken along a plane that bisects throughbores 230, each throughbore 230 includes a radially inner portion 240 and a radially outer portion 245 extending therefrom and generally coaxially aligned. Inner portion 240 extends radially outward from an azimuthally, extending inner surface 250 bounding flowbore 210 to outer portion 245, and is configured to receive an insert 265. In this embodiment, inner portion 240 is tapered, such that the diameter of inner portion 240 at surface 250 is greater than the diameter of inner portion at its base 255, which is connected to outer portion 245 of throughbore 230. Outer portion 245 of throughbore 230 extends radially outward from inner portion 240 to outer surface 235. In cross-section, the diameter of outer portion 245 may be uniform, as illustrated, or it may be nonuniform. Regardless, in the embodiment shown, outer portion 245 has a diameter that is smaller than the diameter of inner portion 240 at its base 255.

Each flexible insert 265 is generally cup-shaped and is insertable within an inner portion 240 of one throughbore 230. In this embodiment, flexible inserts 265 are formed of elastomeric material. As best viewed in FIG. 4, each flexible insert 265 has a base 275, a top 280, a central bore or recess 290, and an outer surface 285 extending longitudinally between base 275 and top 280. In this embodiment, insert 265 is generally frustoconical, having a greater diameter at top 280 than at base 275. So configured, outer surface 285 is tapered to enable insert 265 to be received within inner portion 240 of throughbore 230 such that base 275 of insert 265 is proximate, or abuts, base 255 of inner portion 240, and top 280 of insert 265 is exposed to flowbore 210, as shown in FIG. 3.

Figure 4:
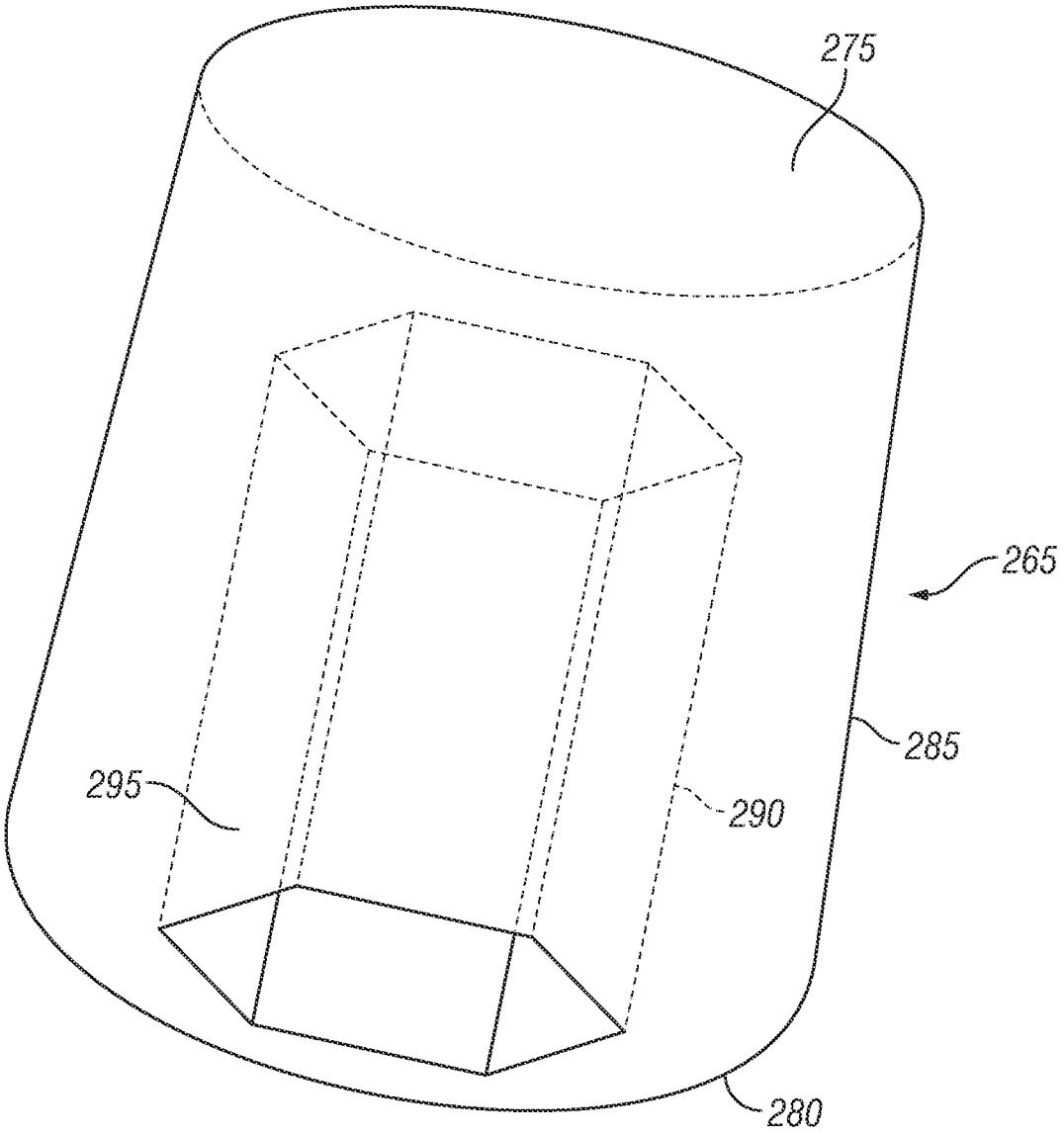
FIG. 4 is a perspective view of an insert of the flow straightener of FIG. 2.

Referring still to FIG. 4, insert 265 further includes a recess 290 extending longitudinally inward from top 280 toward base 275. Recess 290 is configured to receive a pin 260, described in detail below. Further, recess 290 is bounded by an inner surface 295 that is shaped to prevent rotation of pin 260 relative to insert 265 when pin 260 is inserted within recess 290, as shown in FIG. 3. Preferably, recess 290 has a cross-section that is non-circular, such as polygonal, elliptical, or oval in shape. In this embodiment, recess 290 has a hexagonal cross-section.

Each pin 260 is configured to be insertable within a recess 290 of an insert 265. Pin 260 is preferably made from stainless steel for its ability to resist corrosion when exposed to the drilling fluid, but may also be made of other steel alloys or reinforced composite materials. As best viewed in FIG. 5, each pin 260 includes a cylindrical portion 300 and a base 305 coupled thereto. A vane 270 is coupled to or formed integrally with cylindrical portion of pin 260, such that pin 260 supports vane 270. In this embodiment, vane 270 is coupled to cylindrical portion 300 of pin 260 by means of slot 310 that extends radially through cylindrical portion 300 of pin 260 and substantially bisects pin 260. Slot 310 is configured to receive vane 270. In this embodiment, slot 310 is rectangular in cross-section and has a width 315. Vane 270 is fastened within slot 310 using any suitable attachment means, such as, but not limited to, brazing, gluing, riveting, welding, and/or the use of an epoxy.

Figure 5:
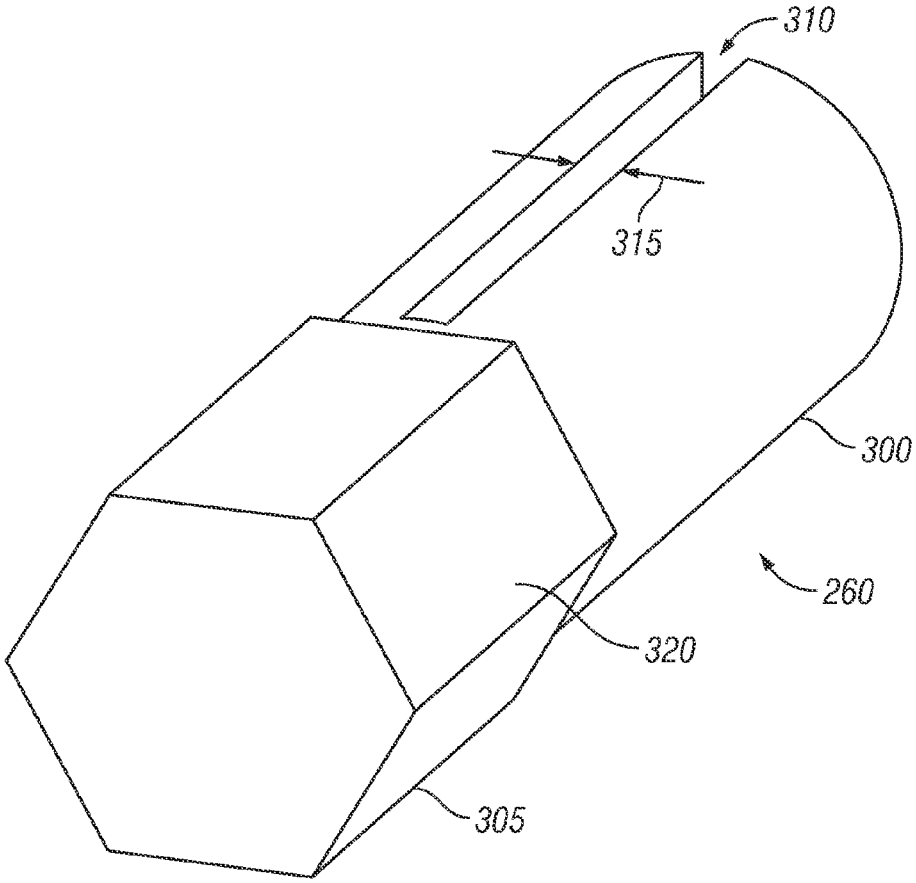
FIG. 5 is a perspective view of a vane-supporting pin of the flow straightener of FIG. 2.

Base 305 of pin 260 is configured to be received within recess 290 of insert 265, as shown in FIG. 3. In some embodiments, base 305 of pin 260 is vulcanized to insert 265. Referring still to FIG. 5, base 305 of pin 260 has a longitudinally-extending outer surface 320 that is shaped to prevent rotation of base 305 of pin 260 relative to insert 265 when inserted within recess 290. Preferably, base 305 has a cross-section which is similar in shape to that of recess 290. In this embodiment, base 305, like recess 290, has a hexagonal cross-section.

Figure 6:
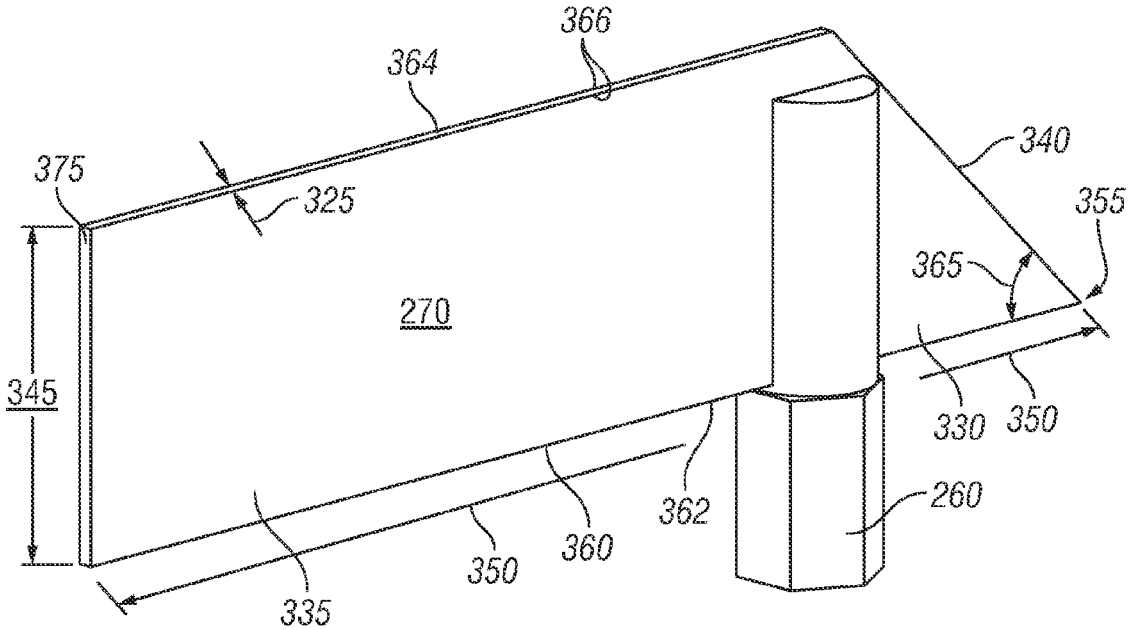
FIG. 6 is a perspective view of a vane of the flow straightener of FIG. 2 supported by the pin of FIG. 5.

Turning now to FIG. 6, each vane 270 has a thickness 325 selected to enable insertion of vane 270 into and through slot 310 of pin 260, as shown. Where drilling fluid is being conveyed through flow straightener 200, the material selected for vanes 270 should preferably be made of a corrosion-resistant material.

Each vane 270 further includes a tapered nose portion 330 and tail portion 335 extending therefrom. In this embodiment, nose portion 330 has a linear, leading surface 340, and tail portion 335 that is rectangular in shape. In other embodiments, leading surface 340 may be nonlinear or curved. The taper of nose portion 330 is characterized by a nose angle 365 formed between leading surface 340 and a longitudinally extending outer surface 360 of vane 270. In the embodiment shown, nose angle 365 is approximately equal to 45 degrees. In other embodiments, however, nose angle 365 may be greater or less than 45 degrees. Nose angle 365 is generally within the range of 30 to 60 degrees, and preferable within the range 30 to 45 degrees. Further, in some embodiments, a leading edge of nose portion 330 is hammed, meaning a small width of the leading edge is folded over itself such that it forms a rigid and slightly rounded leading edge. This results in increased stiffness of the leading edge, and thus nose portion 330.

Further, vane 270 has a length 350, measured from a tip 355 of nose portion 330 along outer surface 360, and a width 345, measured from an end 370 of tail portion 335 along an outer surface 375 normal to surface 360. In some embodiments, the ratio of length 350 to a diameter 212 (FIG. 3) of flowbore 210 is within the range 1.4 to 1.7. Also, length 350 is preferably at least four times width 345. Width 345 of vanes 270 is selected such that when assembled within segment 205, as shown in FIG. 2, vanes 270 do not extend into or across a central, core region 440 of flowbore 210. In some embodiments, the ratio of width 345 to diameter 212 of flowbore 210 is within the range 0.3 to 0.45, and, in the embodiment shown, is about 0.4.

Also, the ratio of the diameter of core region 440 to that of flowbore 210 is approximately 0.125 in the example shown. Providing a core region 440 that is free of or unobstructed by vanes 270 is desirable for at least a couple of reasons. First, fluid passing through core region 440 is less turbulent than fluid passing through flowbore 210 outside core region 440. Thus, there is comparatively less need to reduce fluid turbulence within region 440, and providing core 440 unobstructed by vanes 270 minimizes the resistance to fluid flow therethrough.

Second, because vanes 270 extend longitudinally along flowbore 210, vanes 270 provide some resistance to fluid flow through drilling fluid system 100. The capacity of pump 125 must be sufficient to overcome the flow resistance through drilling fluid system 100, including that resistance created by vanes 270, in order to deliver pressurized fluid to discharge manifold 115 at a desired rate. Increasing width 345 of vanes 270 beyond that which is needed to reduce fluid turbulence, including by extending vanes 270 fully across flowbore 210, for example, would further obstruct fluid flow through system 100 and increase the flow resistance which pump 125 must overcome. A consequence of obstructing fluid flow through flowbore 210 too much is that insufficient fluid is provided to pump 125, which may result in cavitation.

Each vane 270 is not entirely rigid, but may flex and elastically bend to some degree as it resists turbulent fluid flow and provides a fluid-straightening effect. This flexure is a result both of the vane's dimensions, including its substantial length relative to its width, and the substantial narrowness of its thickness in relation to length and width. Such flexure is also provided by attaching vane 270 to pin 260 relatively close to one end, for instance nose 330, and relatively far from the second end, for instance tail 335. Still further flexure is provided by employing the resilient insert 265 used in securing pin 260 to conduit segment 205.

Notwithstanding the description above regarding the capabilities of vanes 270 to flex when used in the embodiment described with reference to FIG. 6, it should be understood that in other applications, vanes 270 may be positioned so as to be substantially rigid with respect to fluid flow. For example, the materials and dimensions of vanes 270 may be selected to provide substantial rigidity and resist bending and flex under load from turbulent fluid passing through flow straightener 200. Further, vanes 270 may be rigidly attached to pins 260 and pins 260, in turn, rigidly secured to conduit segment 205 and in the absence of, for example, resilient members, such as inserts 265 described above.

Figure 7B:
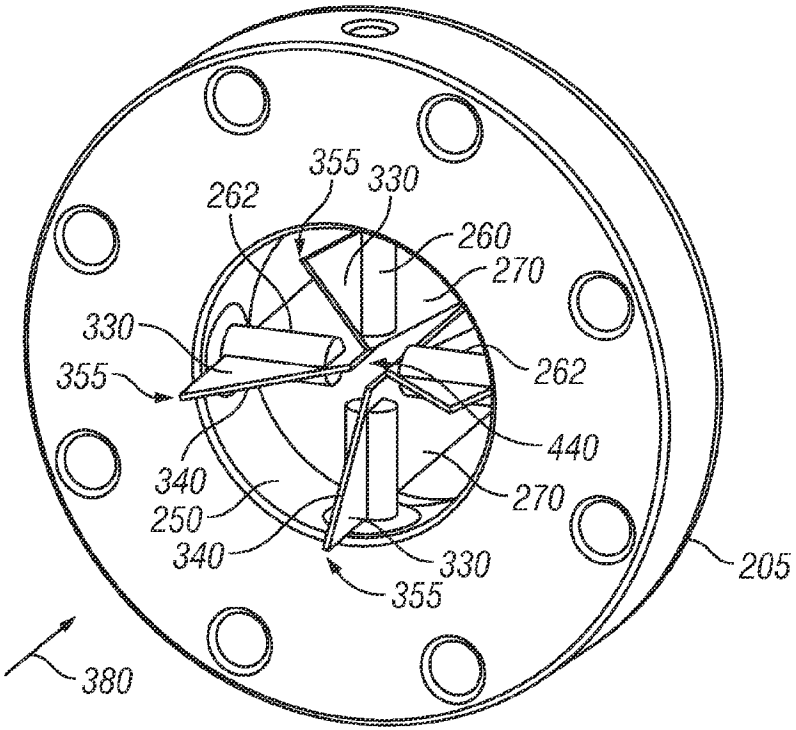
FIGS. 7A and 7B are perspective views of the flow straightener of FIG. 2 as viewed generally from the downstream and upstream directions, respectively.
Figure 7A:
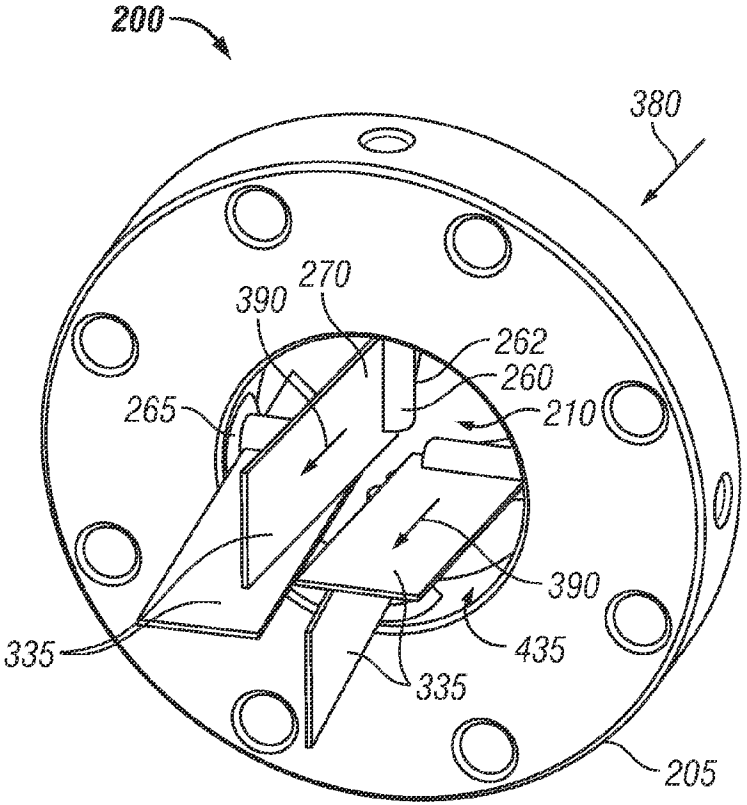

Referring next to FIGS. 7A and 7B, fluid passes from suction manifold 110 (FIG. 1) through flowbore 210 of flow straightener 200 in a direction indicated by arrow 380. When inserted and secured within a slot 310 of a pin 260, each vane 270 is oriented such that vane 270 extends longitudinally in a direction 390 which is substantially parallel to the fluid flow direction 380 with nose portion 330 positioned upstream of tail portion 335. Moreover, each vane 270 is also oriented such that tip 355 of nose portion 330 is proximate inner surface 250 of conduit segment 205, rather than proximate core region 440, as best shown in FIG. 7B. In other words, each vane 270 is positioned such that surface 360, having the longest edges 362, is the radially outermost surface and the opposing surface 364, having edges 366 that are shorter than edges 362, is the radially innermost surface.

Figure 8B:
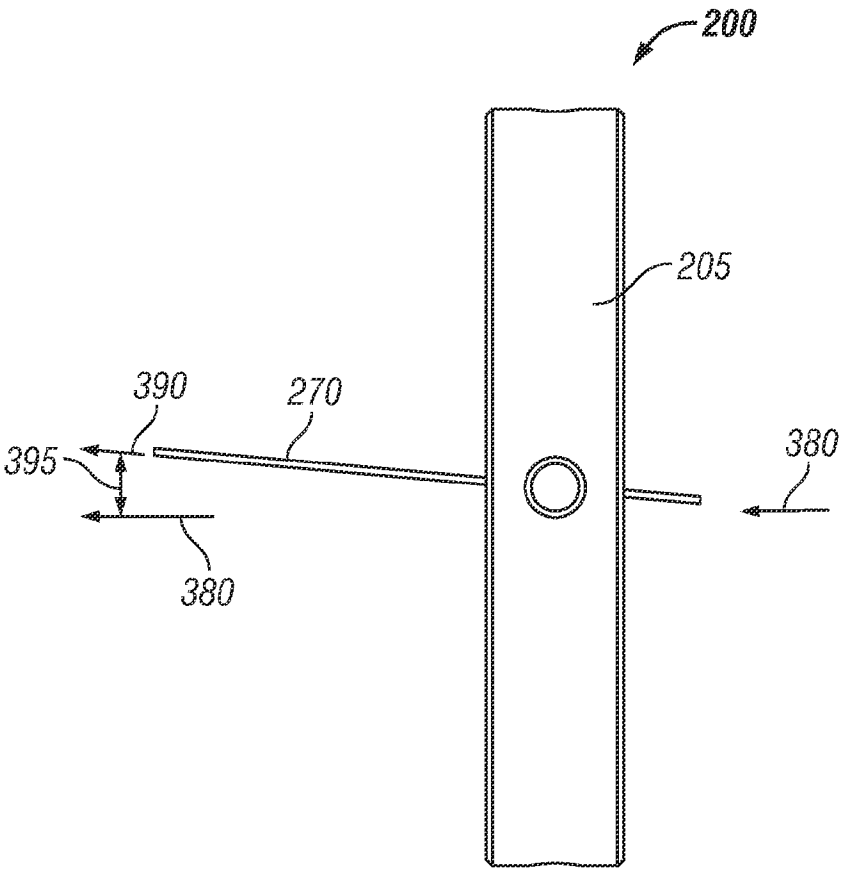
FIGS. 8A and 8B are perspective and side views, respectively, of the flow straightener of FIG. 2.
Figure 8A:
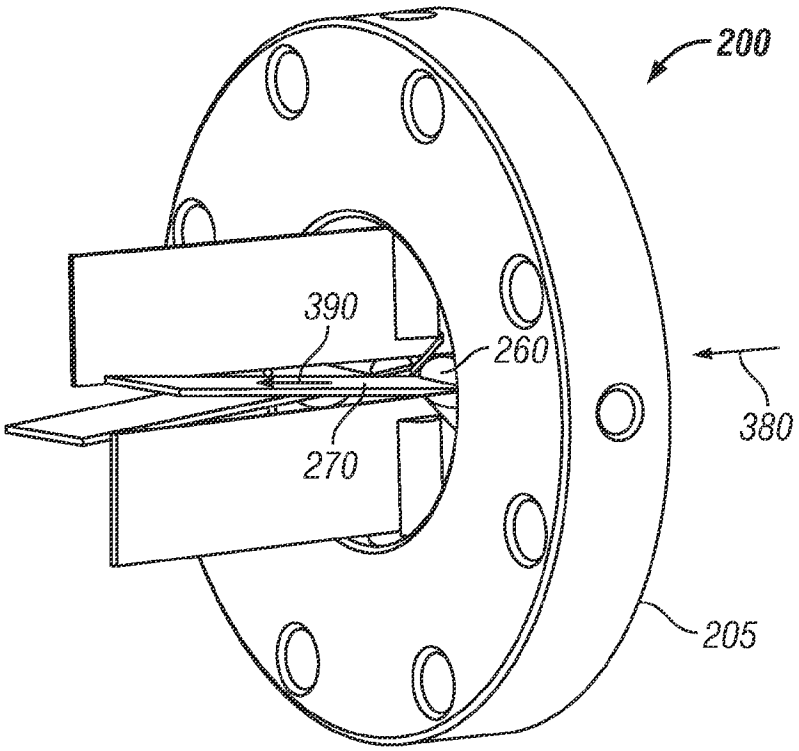

Although each vane 270 extends longitudinally in direction 390 generally parallel to the flow direction 380, direction 390 need not be perfectly parallel to the flow direction 380. Rather, in some embodiments, illustrated by FIGS. 8A and 8B (the latter figure showing only a single vane 270 for clarity), direction 390 is angularly offset relative to the flow direction 380. As shown, each vane 270 extends in direction 390, which is angularly offset from flow direction 380 by an angle 395. This arrangement in which vane 270 is positioned so as to deviate at an angle 395 relative to the intended flow direction 380 or a longitudinal axis of conduit segment 205 may be best described as one in which vane 270 is longitudinally skewed relative to the intended flow direction 380 or the longitudinal axis of conduit segment 205. In such embodiments, angle 395 is generally less than 20 degrees, and is preferably within the range 5 to 15 degrees. In other embodiments, however, vanes 270 may in fact be oriented, longitudinally speaking, parallel to the flow direction 380. In such cases, angle 395 is equal to zero. Furthermore, in some embodiments, angle 395 may vary from one vane 270 to the next.

Figure 9B:
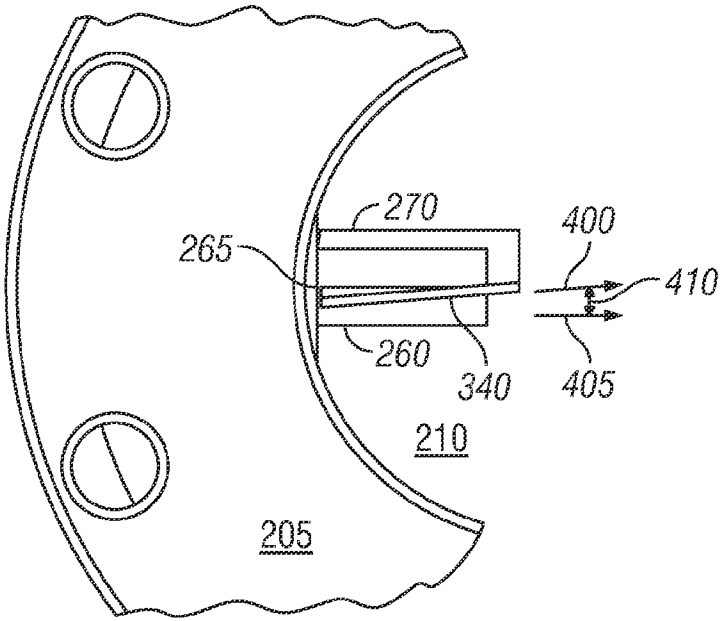
FIGS. 9A and 9B are an end view and an enlarged portion of the end view, respectively, of the flow straightener of FIG. 2.
Figure 9A:
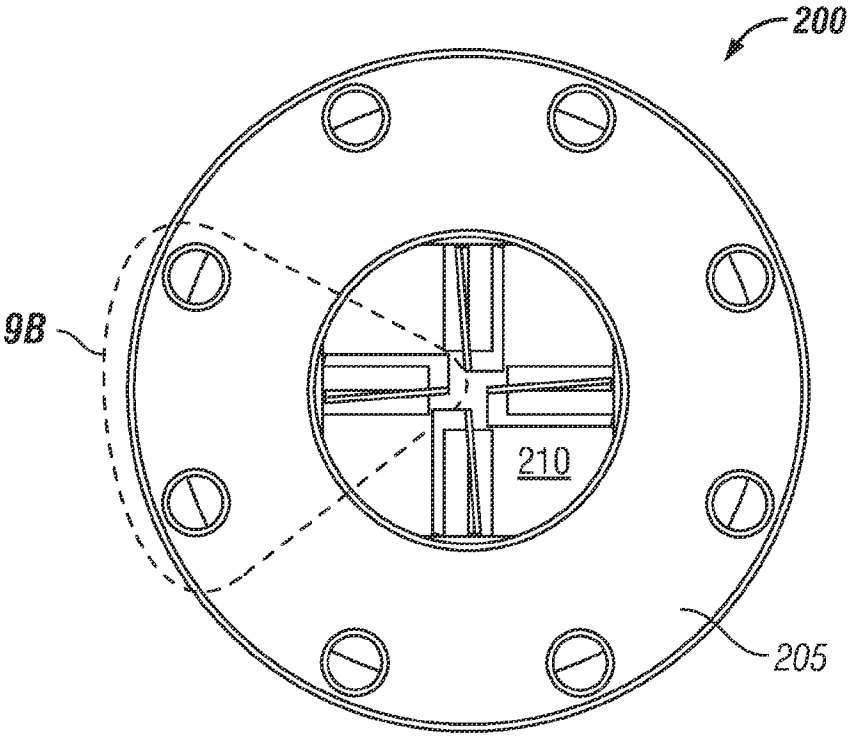

Furthermore, the width 345 (FIG. 6) of each vane 270 also extends radially within flowbore 210 in a direction 400 that is generally normal to surface 250 of conduit segment 205. However, direction 400 need not be perfectly normal to surface 250. Rather, in some embodiments, as illustrated by FIGS. 9A and 9B, each vane 270 is retained in pin 260 in a skewed relationship to a plane 405 that is normal to surface 250 such the generally planar side 368 of vane 270 forms an angle 410 with plane 405. This arrangement is one in which vane 270 is retained in conduit segment 205 in a position such that, when viewed from either the upstream or the downstream end, the cross-section of vane 270 taken where it is retained by pin 260 is not radially aligned with plane 405 (meaning does not extend along plane 405), but is at an angle 410 to plane 405. This arrangement may be referred to herein as a condition in which the vane is radially skewed relative to plane 405. Since a plane 405 that is normal to surface 250 contains or is coincident to a radius of conduit segment 205, this arrangement also is described as one in which vane 270 is retained in conduit segment 205 in a position such that, when viewed from either the upstream or the downstream end, the cross-section of vane 270 taken where it is retained by pin 260 is not radially aligned with a radius of conduit segment 205 (meaning does not extend along the radius), but is at an angle 410 to the radius, and may be referred to herein as a condition in which the vane is radially skewed relative to the radius of conduit segment 205. In other embodiments, however, vanes 270 may in fact be oriented, radially speaking, normally to surface 250. In such cases, angle 410 is equal to zero.

Referring again to FIG. 1, during operation of pump 125, piston 185 reciprocates within cylinder 190. When piston 185 moves to expand the volume within cylinder 190, fluid pressure behind poppet 155 decreases. In response, discharge valve 150 closes, meaning biasing member 180 and the fluid decrease behind poppet 155 cause poppet 170 to seat against sealing member 175. At the same time, the pressure of fluid from suction manifold 110 causes poppet 155 to compress biasing member 165 and unseat from sealing member 160. Once poppet 155 disengages sealing member 160, suction valve 145 is open, and fluid from suction manifold 110 enters compression chamber 140. When piston 185 reverses direction, decreasing the volume within cylinder 190 and increasing the pressure of fluid contained with compression chamber 140, suction valve 145 closes, and discharge valve 150 opens to allow pressurized fluid from compression chamber 140 into discharge manifold 115. While pump 125 is operational, this cycle repeats, often at a high cyclic rate, and pressurized fluid is continuously fed to the fluid destination.

Drilling fluid system 100 includes flow straightener 200 which is configured to reduce the turbulence of fluid passing from suction manifold 110. Vanes 270 of flow straightener 200 subdivide turbulent fluid from suction manifold 110 between channels 425 through which the fluid passes. In doing so, vanes 270 redirect or straighten the fluid flow such that it is more uniform, and therefore less turbulent.

Further, vanes 270 are configured to minimize the disruption to the fluid flow caused by the initial contact of the fluid with vanes 270. Fluid passing from suction manifold 110 into flow straightener 200 initially contacts vanes 270 over leading surfaces 340 of nose portions 330. Due to the taper of nose portions 330, meaning the angular orientation of leading surfaces 340 relative to the fluid flow direction 380, contact between the fluid and vanes 270 gradually increases over the length of leading surfaces 340. Were nose portions 330 not tapered and leading surfaces 340 normal to the fluid flow direction 380, contact between the fluid and vanes 270 would not be a gradual, but a blunt interaction that creates additional turbulence in the fluid. Thus, the taper of nose portion 330 reduces this undesirable effect.

Moreover, vanes 270 are oriented to further minimize the disruption to the fluid flow. Fluid passing from suction manifold 110 into flow straightener 200 is typically more turbulent in a near-wall region 435 (FIG. 7A) proximate inner surface 250 of segment 205 than it is within core region 440 (FIG. 7B) of flowbore 210. Because vanes 270 are also oriented such that tips 355 of nose portions 330 are within turbulent near-wall region 435 proximate inner surface 250 of segment 205, the more turbulent fluid passing through near-wall region 435 initially contacts vanes 270 over a relatively small area, specifically, tips 355. Contact between the turbulent fluid and vanes 270 then gradually increases as the fluid engages and passes over at least a portion of tapered leading surfaces 340 of vanes 270. Enabling the turbulent fluid to gradually engage vanes 270 in this manner reduces the tendency for initial contact between the turbulent fluid and vane surfaces 340 to create additional turbulence within the fluid.

Still further, the shape of pins 260 may be selected to minimize the resistance of pins 260 to, and therefore the pressure decrease of, fluid flow passing through flowbore 210 of flow straightener 200. Fluid passing from suction manifold 110 into flow straightener 200 initially contacts each tapered nose 330 of vanes 270 and is divided or separated into two fluid streams. Each stream then flows along opposite sides of vane 270 toward cylindrical portion 300 of pin 260 supporting vane 270. When each stream contacts portion 300, it flows around portion 300. Because portion 300 is cylindrical in shape, a low pressure region is created proximate the apex zone 262 of pin 260. Fluid is drawn into this low pressure region, and assumes the velocity of fluid near the surface of pin 260. After flowing around pin 260, each fluid stream continues along length 350 of vane 270 toward tail 335 where both streams reunite. Length 350 of vane 270 may be selected such that both streams have substantially the same velocity when they reunite at tail 335 of vane 270. The effect of cylindrically-shaped portion 300 of pin 260 enables a lower pressure drop across pin 260 than would otherwise be obtained with a pin having a different shape.

As fluid passes through flow straightener 200, the size of the radial cross-section of each outer portion 245 of throughbores 230 in conduit segment 205 relative to that of the radial cross-section of each inner portion 240 in which inserts 265 are disposed enable pins 260 to maintain the position of vanes 270. Fluid passing through flowbore 210 of flow straightener 200 exerts pressure loads on tops 280 of inserts 265. Because the diameter of outer portions 245 of throughbores 230 is smaller than that of inner portions 240 at their bases 255, inserts 265 are prevented from disengaging throughbores 230 by extruding through outer portions 245 in response to the pressure load. Instead, flexible inserts 265 are simply compressed by the pressure loads within inner portions 240 of throughbores 230, and the pre-selected positions of vanes 270 are maintained.

Also, as fluid passes through flow straightener 200, the cross-sectional shapes of recesses 290 of inserts 265 and bases 305 of pins 260 disposed therein enable pins 260 to maintain the orientation of vanes 270. Fluid passing through flowbore 210 of flow straightener 200 contacts vanes 270 and imparts loads thereto. Even so, vanes 270 are prevented from rotating in response to the loads due to the interaction between recesses 290 of inserts 265 and bases 305 of pins 260. As described above, the shape of surfaces 295, which bound recesses 290 in which bases 305 of pins 260 are disposed, and the shape of surfaces 320 of bases 305 are configured to prevent rotation of pins 260 relative to inserts 265.

As described, flow straightener 200 includes a number of features, each of which enables the reduction of the turbulence within fluid passing from suction manifold 110. Consequently, fluid entering valve assembly 120 contacts poppet 155 of suction valve 145 more uniformly, reducing the tendency for poppet 155 to flutter, or act unstably. Moreover, fewer bubbles are created as the comparatively less turbulent fluid passes around poppet 155 into compression chamber 145. Reduced fluttering of poppet 155 and fewer bubbles within compression chamber 145 enable increased efficiency of pump 125. Also, fewer pressure pulsations are created within the fluid during the compression cycle of pump 125.

Furthermore, flow straightener 200 is configured to dampen pressure pulsations created within fluid upstream of flow straightener 200, such as those created by cyclic deformation of suction manifold 110. Pressure pulsations created in fluid upstream of flow straightener 200 are carried by the fluid as the fluid flows toward and into flow straightener 200. When the fluid contacts vanes 270 of flow straightener 200, pressure forces, or loads, are imparted to vanes 270 by the fluid. The imparted loads are then transferred through vanes 270 and pins 260 coupled thereto to flexible inserts 265, where the pressure loads are absorbed.

The above-described embodiment is directed to a drilling fluid system 100 for pressurizing drilling mud. Drilling fluid system 100 includes a flow straightener 200 in accordance with the principles disclosed herein. Flow straightener 200 is positioned downstream of suction manifold 110, and is configured to reduce the turbulence of and pressure pulsations propagated by drilling fluid passing therethrough. Reductions in flow turbulence enable increased efficiency of pump 125. Moreover, reductions in pressure pulsations propagated by the drilling fluid decrease disturbances to downhole instrumentation and lessen the likelihood of fatigue damage to downstream piping.

One of ordinary skill in the art will readily appreciate the applicability of the flow straightener in other positions within drilling fluid system 100. For example, a flow straightener may be positioned on the discharge side of pump assembly 105. In such embodiments, it is sometimes desirable for fluid flow on the discharge side to have a higher level of turbulence, as compared to that of fluid entering the suction side of pump assembly 105. Consequently, angle 395 and/or angle 410 may be selectably adjusted to increase the turbulence of fluid passing through the flow straightener.

Also, one of ordinary skill in the art will readily appreciate the applicability of a flow straightener in accordance with the principles disclosed herein within other types of fluid conveyance systems wherein it is desired to reduce fluid turbulence and/or dampen pressure pulsations propagated by a fluid. Thus, the flow straightener disclosed herein is not limited to the context of a drilling fluid system.

While various embodiments have been shown and described, modifications thereof can be made by one skilled in the art without departing from the spirit and teachings herein. The embodiments herein are exemplary only, and are not limiting. Many variations and modifications of the apparatus disclosed herein are possible and within the scope of the invention. Accordingly, the scope of protection is not limited by the description set out above, but is only limited by the claims which follow, that scope including all equivalents of the subject matter of the claims.

What is claimed is:

1. An apparatus for conveying fluid, the apparatus comprising:

a conduit segment having an inner surface and an interior volume for conveying the fluid in a predetermined direction of flow; and a plurality of pins flexibly coupled to the conduit segment, wherein each pin is configured to support one of a plurality of elongate vanes within the interior volume.

2. The apparatus of claim 1, wherein the vanes are coupled to the pins such that the vanes are spaced apart from the inner surface.

3. The apparatus of claim 1, wherein at least one of the vanes is radially skewed relative to a direction that is normal to the inner surface.

4. The apparatus of claim 1, wherein each of the pins comprises a base portion extending into the conduit segment and a vane-supporting portion extending from the base portion and into the interior volume.

5. The apparatus of claim 4, wherein at least one of the base portions has a non-circular cross-section.

6. The apparatus of claim 5, wherein the cross-section of the at least one base portion has a shape selected from the group consisting of polygonal, elliptical, and ovoid.

7. The apparatus of claim 4, wherein at least one of said vane-supporting portions includes a slot, and wherein one of said vanes is disposed in said slot.

8. The apparatus of claim 4, further comprising an elastomeric insert disposed between at least a first of the pins and the conduit segment, wherein the flexible insert has a receptacle configured to receive the base portion of the first pin.

9. The apparatus of claim 4, further comprising a plurality of elastomeric inserts, wherein each insert is disposed between one of the pins and the conduit segment, wherein each elastomeric insert has a receptacle configured to receive the base portion of the corresponding pin, and wherein each of the elastomeric inserts has a tapered outer surface that engages a correspondingly tapered surface formed in the conduit segment.

10. The apparatus of claim 9, wherein each of the elastomeric inserts comprises an elastomeric material and is vulcanized to the base portion of the corresponding pin.

11. A system for conveying fluid, the system comprising:

a conduit segment having an interior volume for conveying the fluid in a predetermined direction of flow, wherein the conduit segment includes a cylindrical inner surface, and a plurality of pin-receiving bores extending into the inner surface;

a plurality of pins having a first portion and a second portion, wherein the first portion of each of the plurality of pins is flexibly inserted within one of the plurality of bores and the second portion extends into the interior volume; and a plurality of elastomeric inserts each disposed between one of the pin-receiving bores and the corresponding pin, wherein each insert includes a receptacle configured to receive the first portion of the corresponding pins.

12. The system of claim 11, wherein each insert includes a tapered outer surface that slidingly engages with a tapered portion of the corresponding pin-receiving bore.

13. The system of claim 11, further comprising:

a pump disposed downstream of and fluidicly coupled to the conduit segment, and a flexible connection disposed between the conduit segment and the pump.

14. The system of claim 13, wherein the flexible connection has a first end coupled to the conduit segment, the first end having a first cross-sectional area substantially normal to the direction of flow, and a midsection disposed downstream of the first end, the midsection having a second cross-sectional area substantially normal to the direction of flow and greater than the first cross-sectional area.

15. The system of claim 14, further comprising a plurality of elongate vanes disposed within the interior volume, wherein each vane is coupled to the second portion of one of the pins, and wherein each of the vanes extends into the flexible connection.

16. The system of claim 15, wherein each of the plurality of vanes has a first end and a second end, wherein the second end is downstream of the first end and disposed between the first and second cross-sectional areas of the flexible connection.

17. An apparatus for conveying fluid in a predetermined direction from upstream to downstream, the apparatus comprising:

a conduit segment having an inner surface and an interior volume; and a plurality of vanes disposed within the interior volume, the vanes including first and second ends, wherein the first end is tapered and is upstream of the second end;

a plurality of pins flexibly coupled to the inner surface of the conduit segment, wherein each pin flexibly supports one of the plurality of vanes within the interior volume.

18. The apparatus of claim 17, wherein each of the plurality of pins has a first portion flexibly anchored to the conduit segment and a second portion extending into the interior volume, wherein the second portion includes a slot retaining one of the vanes therein.

19. The apparatus of claim 18, wherein the vanes include a midpoint, and wherein pins connect to the vanes at a location between the midpoint and one of the first and second ends.

20. The apparatus of claim 17, further comprising a plurality of flexible inserts interconnecting the pins and the conduit segment.

21. The apparatus of claim 20, wherein each flexible insert has a pin-receiving recess and a generally frustoconical outer surface.

22. The apparatus of claim 21, wherein the pin-receiving recess of each insert has a shape that is non-circular, and wherein the first portion of each pin has a cross-section that corresponds to the shape of the pin-receiving recess of the corresponding insert.

23. The apparatus of claim 22, wherein the shape of the pin-receiving recess of each insert is selected from the group consisting of polygonal, elliptical, and ovoid.

* * * * *